US006860311B1

(12) United States Patent
Minor

(10) Patent No.: US 6,860,311 B1
(45) Date of Patent: Mar. 1, 2005

(54) TELESCOPIC DOOR AND PANEL FORMING APPARATUS

(76) Inventor: Robert L Minor, 616 Minor Dr., South Jacksonville, IL (US) 62650

( * ) Notice: Subject to any disclaimer, the term of this patent is extended or adjusted under 35 U.S.C. 154(b) by 38 days.

(21) Appl. No.: 10/613,087

(22) Filed: Jul. 2, 2003

(51) Int. Cl.[7] ..... E05D 15/16
(52) U.S. Cl. ..... 160/202; 160/193
(58) Field of Search ..... 160/202, 193, 160/222, 205, 214, 223

(56) References Cited

U.S. PATENT DOCUMENTS 188,136 A * 3/1877 Hoffmann ..... 160/6
1,096,446 A * 5/1914 Mesker et al. ..... 160/1
1,126,864 A * 2/1915 Rankin ..... 160/202
1,143,846 A * 6/1915 Manuel ..... 49/126
1,183,402 A * 5/1916 Prescott ..... 160/193
1,788,651 A * 1/1931 Alderson ..... 160/193
1,927,982 A * 9/1933 Howard ..... 160/193
2,228,608 A * 1/1941 Morgan ..... 160/190
2,523,844 A * 9/1950 Rohrman ..... 160/202
3,204,691 A * 9/1965 Rohrman ..... 160/202
3,304,994 A * 2/1967 Kozak ..... 160/202
3,313,338 A * 4/1967 Knight ..... 160/189
3,341,971 A * 9/1967 Hartman, Jr. ..... 49/7
4,114,674 A * 9/1978 Gabry ..... 160/222
4,785,590 A * 11/1988 Jones ..... 52/64
5,611,382 A * 3/1997 Sferra ..... 160/113
6,339,905 B1 * 1/2002 Craig ..... 52/174

* cited by examiner

*Primary Examiner*—Blair M. Johnson
(74) *Attorney, Agent, or Firm*—Michael I. Kroll

(57) ABSTRACT

A telescoping garage door assembly and door panel forming apparatus is described. The telescoping garage door assembly includes a plurality of interacting panels and means for moving the plurality of interacting panels. The panels include a first or top panel, at least one intermediate panel, and a last or bottom panel. The panels have corrugations and include brackets having flanges. The means for moving the plurality of panels includes a framework configured for supporting a plurality of guide rods and a drive mechanism. The flanges of the panels are configured to receive the guide rods. The drive mechanism includes two interconnected pulley systems with each pulley system including a pair of pulleys connected by a flexible member. The flexible members have lifting brackets configured for connecting with and moving the plurality of interacting panels on the guide rods between an open and a closed position. A garage door panel fabricating machine is also described that is configured for fabricating corrugated panels.

18 Claims, 10 Drawing Sheets

TELESCOPIC DOOR AND PANEL FORMING APPARATUS

BACKGROUND OF THE INVENTION

1. Field of the Invention

The present disclosure relates to garage doors. More particularly, the present disclosure relates to garage doors assemblies configured for telescopic storage.

2. Description of the Prior Art

Garage doors having a plurality of separate panels configured for storing separately appeared not long after the first automobiles. Doors having generally vertically extended panels for closure and vertically stowed panels have typically employed a single track connecting the plurality of panels that are moved sequentially from a lowermost panel by a cable and pulley system. The lowermost panel is configured to connect with the next upper panel which as it is elevated connects with the next upper panel until the movement of the lowermost panel is moving all of the panels vertically into a stored position. These systems, however, are vulnerable to jamming because of the interrelation of the panels and the travel of the panels on a single axis.

What is needed is a compact telescoping garage door opening system that can store the garage door panels vertically in a small space.

The invention is a horizontal hatch cover for a ship including a plurality of cover sections stacked in the open position preferably on two angled bars supported by and movable within slotted guides. The bars are movable between a closed cover position substantially under the hatch covers and an open hatch position wherein the angled bars are in an extended position extending from the slotted guides clear of the hatch and positioned for receiving the telescoping hatch covers.

The present invention includes a pair of grooved slideways mounted on opposite sides of the garage door has upper ends curving upwardly and inwardly and a plurality of metal plates disposed between the slideways. Each plate having reduced end portions disposed in grooves of the slideways. The reduced portions being deflected such that they lie in a common plane while the bodies of the plates lie in parallel inclined planes. The lower edge portion of each of the plates is bent inwardly at right angle and the upper edge portion is bent outwardly at right angles whereby convenient finger holes are provided to facilitate the hand manipulation of the plate. The plates are adapted for moving along the slideways to the horizontal tops storage area of the slideways and into a nested vertical stack of horizontally positioned plates.

A door structure including a frame outlining the door opening and a plurality of vertically movable panels mounted in connection with the frame. The panels have upper and lower inwardly projecting flanges. The panels are extensible downwardly relative to each other between a nested stored position and an extended open position forming a closure for the opening. The door structure also includes means for raising the panels to an opening-clearing position such as a wire positioned through holes defined in the flanges of the panels. Each panel at its lower end when extended overlaps the upper end of the adjacent panel below and a cooperating slide means between the panels holds the panels against horizontal movement relative each other. The door structure includes counterweights assisting in the retaining of the panels in the open position.

Disclosed is a curtain for theaters having the frames filled with fire-proof material, and each frame constructed with vertical rods upon which the adjoining frames move and are guided, and each frame being arranged at its side edges in guide grooves, in combination with one or more hoisting-ropes, extending from a windlass to the bottom frame of the curtain, substantially as described.

A grain door is described having a plurality of nestable door members connected by a plurality of flexible cables. The lowermost of the door members is a certain length and the others progressively longer. Guides tapering from the top to the bottom are positioned to engage the ends of the door members when the door members are in a closed position. The guides act as supports for the door members. The door members and the guides are so relatively sized that when the door members are closed they will overlap while being supported by the guides. The plurality of flexible cables extends through the door members and a drum means is configured for winding the cables. A rotatable member for actuating said drum means for raising said door members. All of the door members are slidable on the cables except the lowermost door member. When the cables are wound on the drum means, the lowermost door member will be raised and in turn will raise the remaining door members as the cables are wound by the power operated means for actuating the rotatable member.

A vertically moving door is described including a plurality of parallel channel-like guides at opposite sides each extending from the top to a different distance downward and thereby each guide determining a downward limit of movement of one of a plurality of door panels positioned therein. Each one of the plurality of vertically moveable horizontally extending sheet metal door panels is positioned in one of the guides. A tube is secured to the bottom of each door panel and extending into die guide at each side. The top of each door panel is curved into the path of the tube on the adjoining door panel above the position of the tube such that each lower panel tube is configured to be received by and lifted by the curved upper portion of the upwardly adjoining panel.

The invention includes a plurality of wedge shaped unitary panel supporting members configured for positioning on the door post and receiving the panels of the door. The support members are applied in pairs or more to retain the panels of a vertically sliding door in vertical succession to close a doorway. The panel supporting member include a substantially linearly aligned series a plurality of projections including a back portion common to all other projections and two substantially parallel spaced apart sidewalls connected with and perpendicular to the back portion. A lip is formed along the outer edge of each of the sidewalls connected and is perpendicular to the sidewalls. The lips terminate in an edge substantially parallel to the plane of said sidewalls so as to form a slot. The slot is positioned at an oblique angle to the longitudinal plane of the back portion such that the door panels have projecting sliders supported by means of the sliders fitting into the slots, the lower edge of each panel resting upon the top edge of the next lower projection. The door panels are raised and lowered by a motor driving a cable system connected to the lowermost panel that sequentially engages or releases the adjacent panel as they ascend or descend.

An enclosure for use as a garage, storage shed and the like comprises a roof supported at its four corners by vertical posts, and front, back and opposed side walls each including a plurality of telescoping wall panels movable between a raised position in which the wall panels are nested together near the roof and a lowered position wherein the wall panels extend between the roof and ground. A cable and pulley system is operable to raise and lower all four walls simultaneously to provide access to the interior of the enclosure from any point along the perimeter of the enclosure.

A retractable screen assembly is disclosed for a standard garage door of the type that is selectively raised and lowered to open and close the garage. The assembly includes one or more screen panels stacked against and extending across an inside surface of the garage door. The panels are telescopically mounted to the garage door such that they are selectively positioned in a retracted condition wherein the panels are held in substantially parallel juxtaposition against the garage door, and an extended condition wherein the panels depend from the garage door and extend generally between the lower edge of the garage door and a floor of the garage when the garage door is raised. The panels are releasably locked in the retracted condition to permit the garage door to be raised with the panels in the retracted condition. The panels are released so that they slide into the extended condition when the garage door is raised.

An aperture covering including counterbalanced individual interlocking panels that are disengaged when stored. The aperture covering includes at least two interconnectable panels, each panel having a surface defining at least two notches and at least one track positioned having a toothed belt configured for supporting the moving of the panels and mating with the notches of the panels. The panel unlocked for storage and become interlocked as they are deployed from storage. While these segmented panel doors may be suitable for the purposes for which they were designed, they would not be as suitable for the purposes of the present invention, as hereinafter described.

SUMMARY OF THE PRESENT INVENTION

A telescoping garage door assembly including a plurality of interacting panels defining a garage door. Each panel of the plurality of panels has a face, a back, and two opposing sides. The front of each panel defines a first plane and the first planes of the plurality of panels are parallel. The plurality of panels is arranged in sequence such that a first panel defines the top of the door and a last panel defines the bottom of the door.

A pair of brackets having flanges is connected to the back of each panel. Each panel of the plurality of panels is positioned in spaced relation such that the upper flange of the panel interacts with the upper flange of the adjacent panel.

The means for moving the plurality of interacting panels includes a framework supporting a plurality of guide rods and a driving mechanism. Each panel of the plurality of panels is connected to at least two guide rods by the flanges. The drive mechanism includes two lifting brackets with each lifting bracket being positioned on a movable flexible member configured for receiving the flanges of the last panel. The lifting brackets are configured for moving the plurality of interacting panels along the guide rods between an open position and a closed position.

One of the primary objects of the present invention is to provide a door comprised of a plurality of panels that are vertically stored adjacent to the door header when in the open position.

The present invention overcomes the shortcomings of the prior art by providing a garage door having vertically retractable panels that are moved on separate guide rods and stored in the door header. The retractable door panels eliminate the need for overhead horizontal tracks providing additional overhead storage space within the garage. In addition, the garage door provides additional safety from people or objects in the door closure path due to the weight being distributed between the segmented panels instead of the weight of the entire overhead door coming down in a single closure path. Furthermore, the present invention provides for an additional element in the form of a machine for forming the door panels.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

DESCRIPTION OF THE REFERENCED NUMERALS

Turning now to the reference numerals used, the following numbering is used throughout the various drawing figures:

10 telescopic garage door apparatus and door panel forming machine
20 telescopic garage door apparatus
30 plurality of panels
31 one panel
32 face of a panel
33 back of a panel
34 top of a panel
35 bottom of a panel
36 first side of a panel
37 second side of a panel
38 corrugations positioned on the face of the panel
40 pair of brackets
41 bracket
42 upper flange
44 first hole defined in upper flange
45 second hole defined in upper flange
46 end of flange
47 lip positioned on the end of the flange
48 lower flange
49 at least one hole defined in lower flange
50 means for moving the plurality of panels
55 framework
60 plurality of guide rods
61 guide rod
62 top of guide rod
64 bottom of guide rod
66 bracket for securing guide rod
67 fastening means
68 stop
70 drive mechanism

71 first pair of pulleys
72 upper pulley of first pair of pulleys
73 lower pulley of first pair of pulleys
75 second pair of pulleys
76 upper pulley of second pair of pulleys
77 lower pulley of second pair of pulleys
81 first flexible member
83 second flexible member
85 lifting bracket
87 synchronization rod
90 motive force means
92 electric motor
94 cord
100 door panel forming machine
105 housing
108 rack
110 plurality of upper rollers
112 upper roller
113 gap
130 plurality of lower rollers
132 lower roller
133 gap
140 bias means
150 motor
160 power transfer means

BRIEF DESCRIPTION OF THE DRAWING FIGURES

In order that the invention may be more fully understood, it will now be described, by way of example, with reference to the accompanying drawing in which.

DETAILED DESCRIPTION OF THE PREFERRED EMBODIMENT

Figure 1:
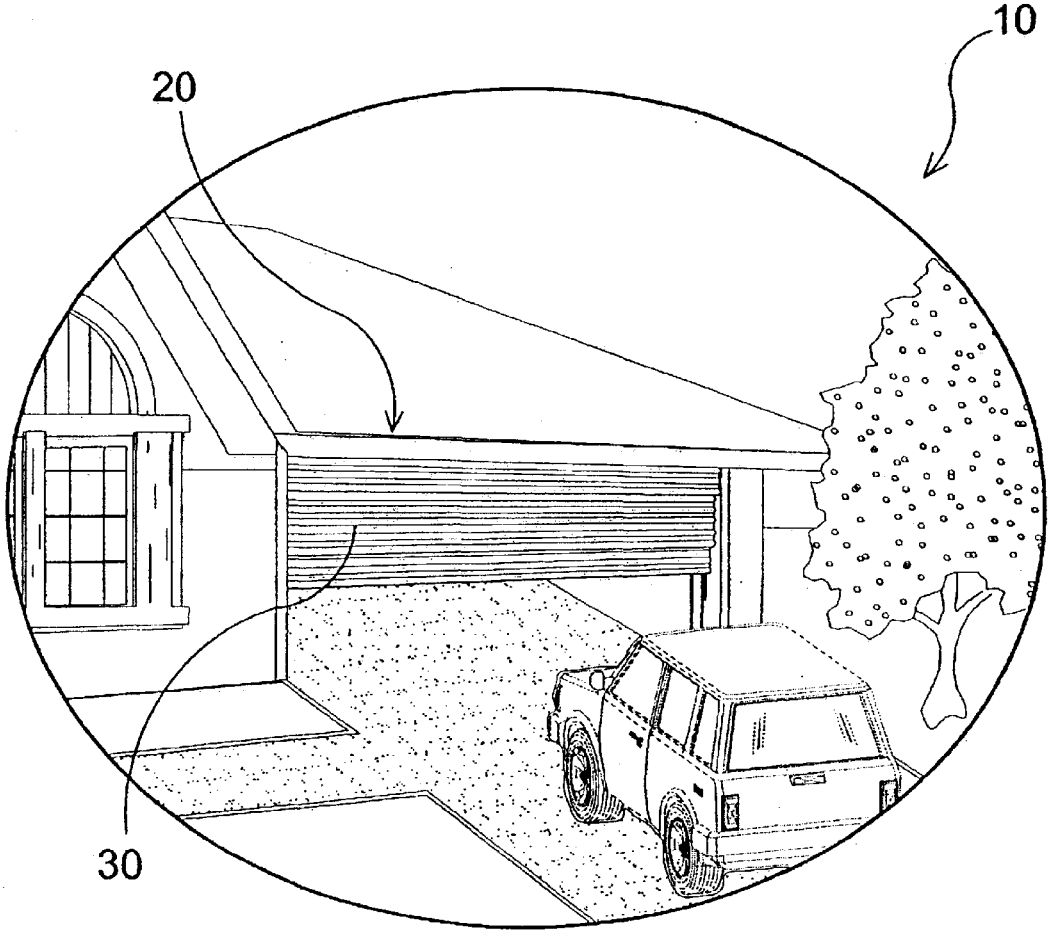
FIG. 1 is a frontal perspective view of a telescopic garage door assembly in a closed position adapted for positioning in a garage and constructed in accordance with the present disclosure.
Figure 2:
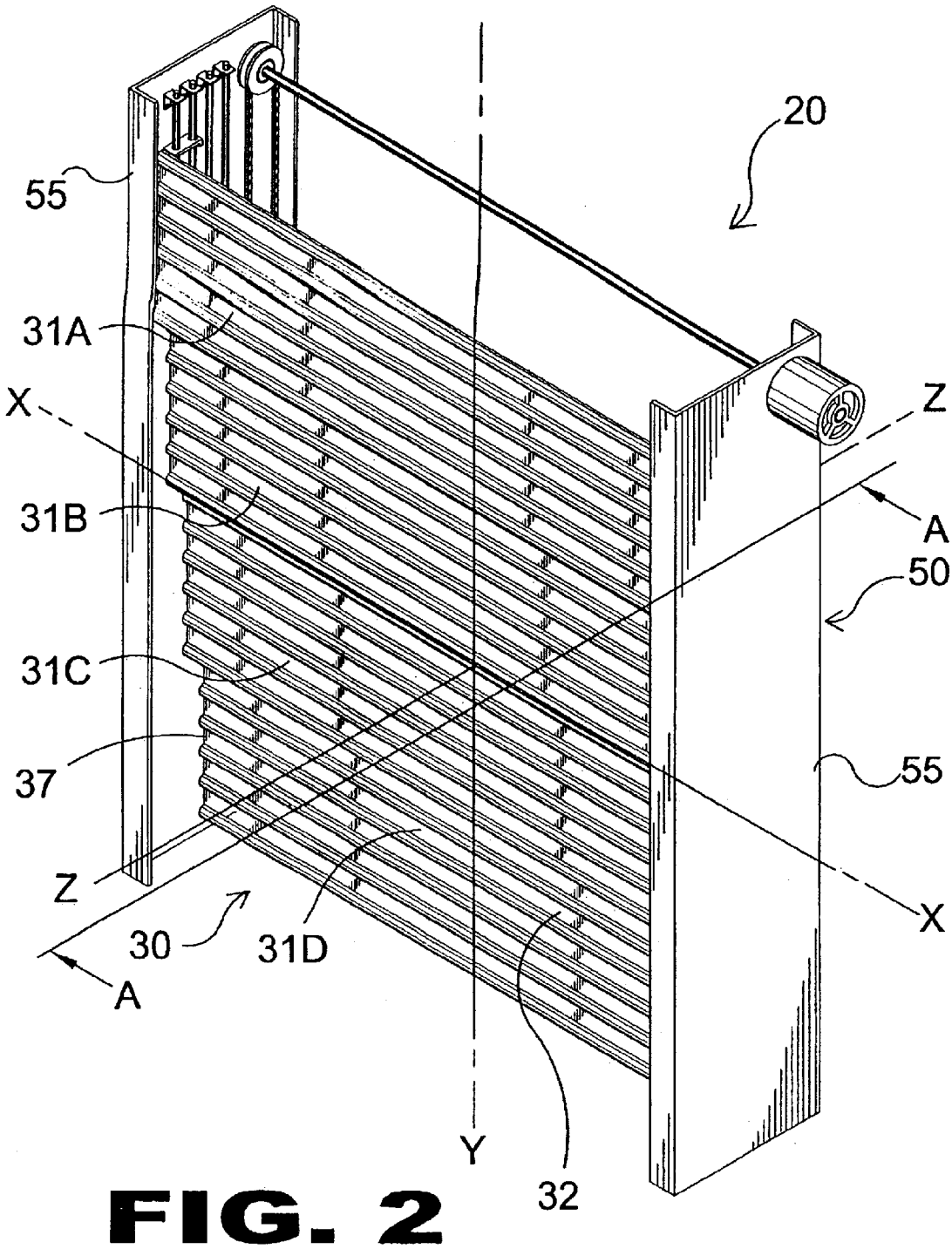
FIG. 2 is a frontal perspective view of the telescopic garage door assembly of FIG. 1.
Figure 3:
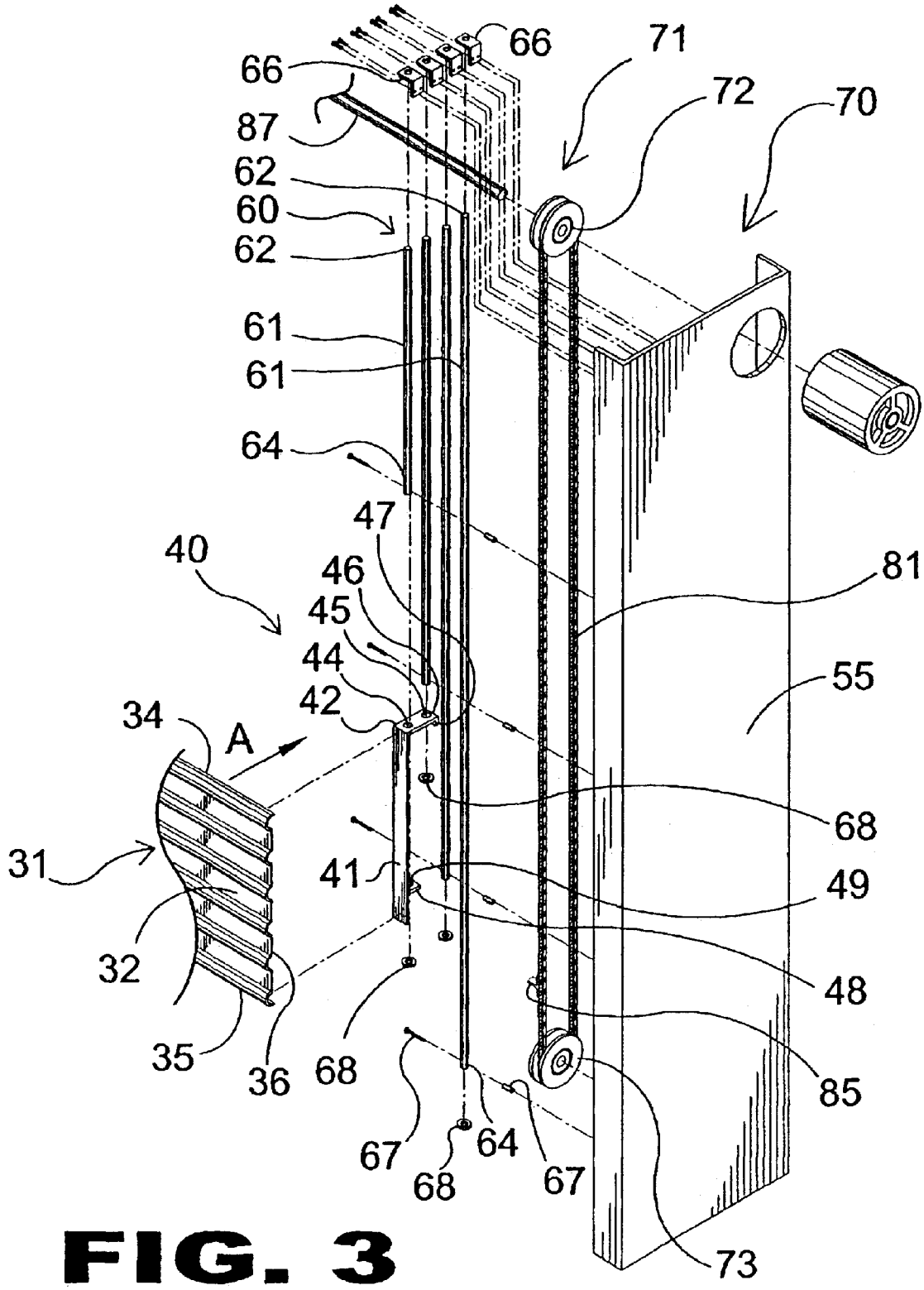
FIG. 3 is a frontal perspective view of means for movement and a portion of a panel of the telescopic garage door assembly of FIG. 1.
Figure 4:
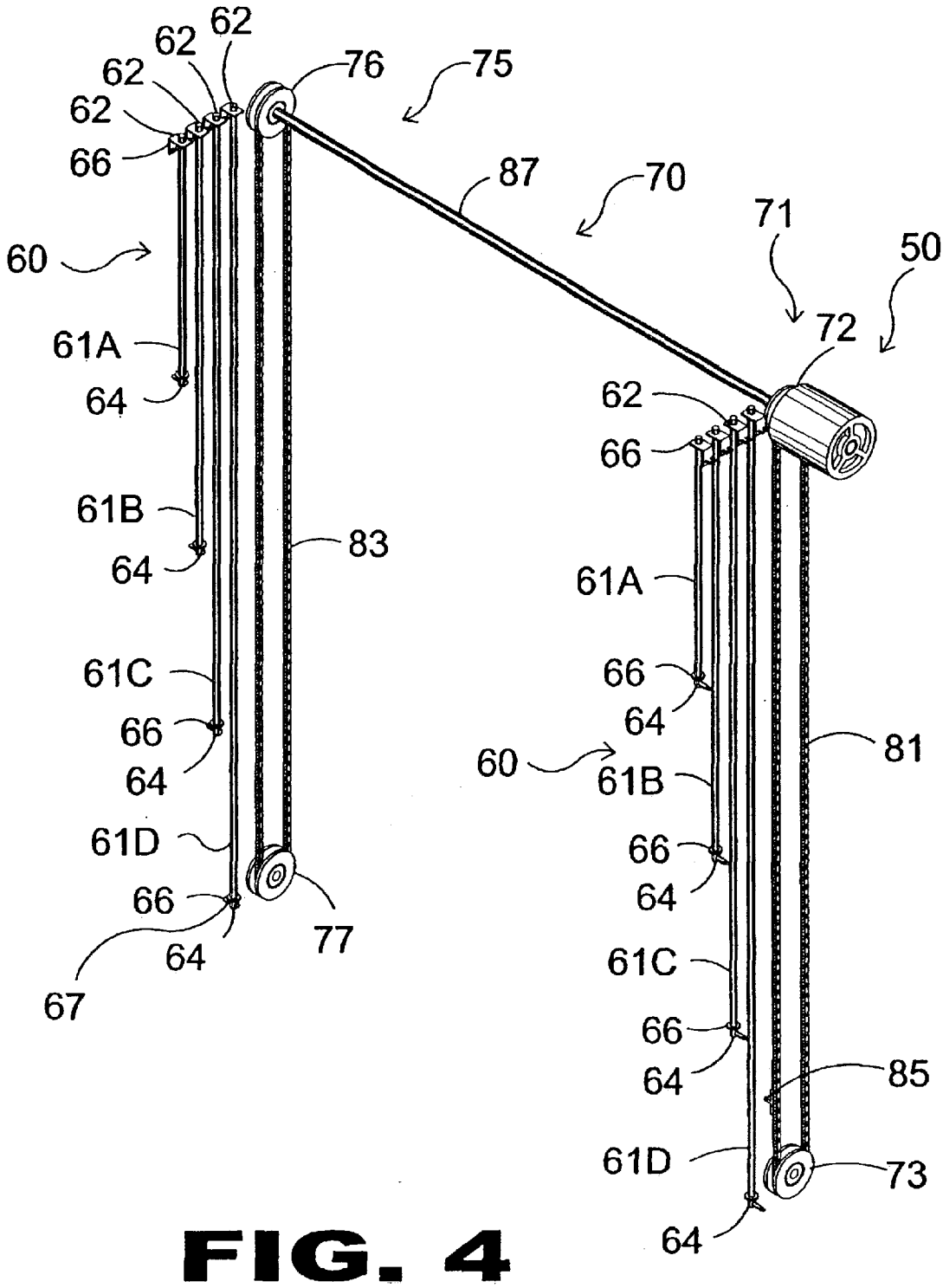
FIG. 4 is an exploded side perspective view of a portion of the means for movement of the telescopic garage door assembly of FIG. 1.
Figure 5:
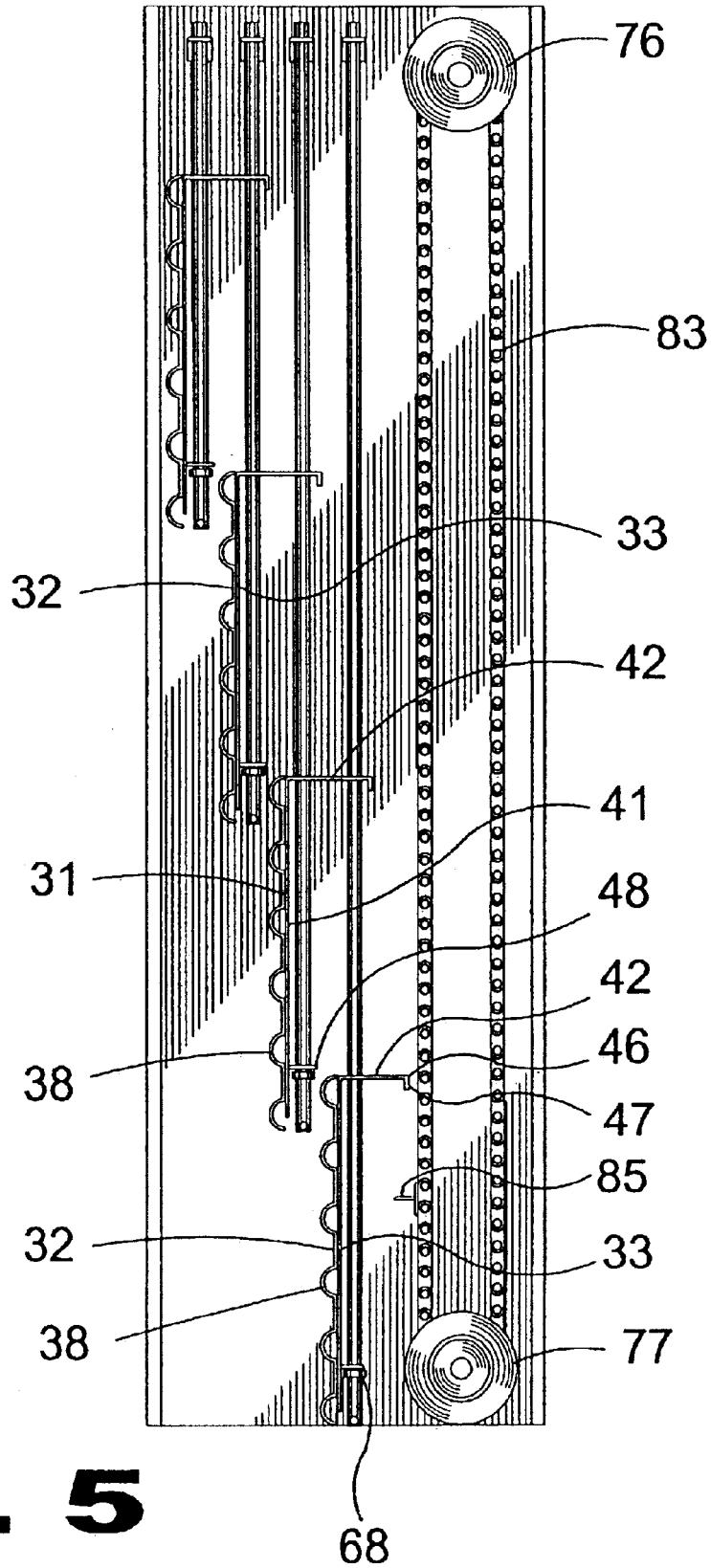
FIG. 5 is a cross-sectional side view of the garage door assembly of FIG. 2 along line A—A.
Figure 6:
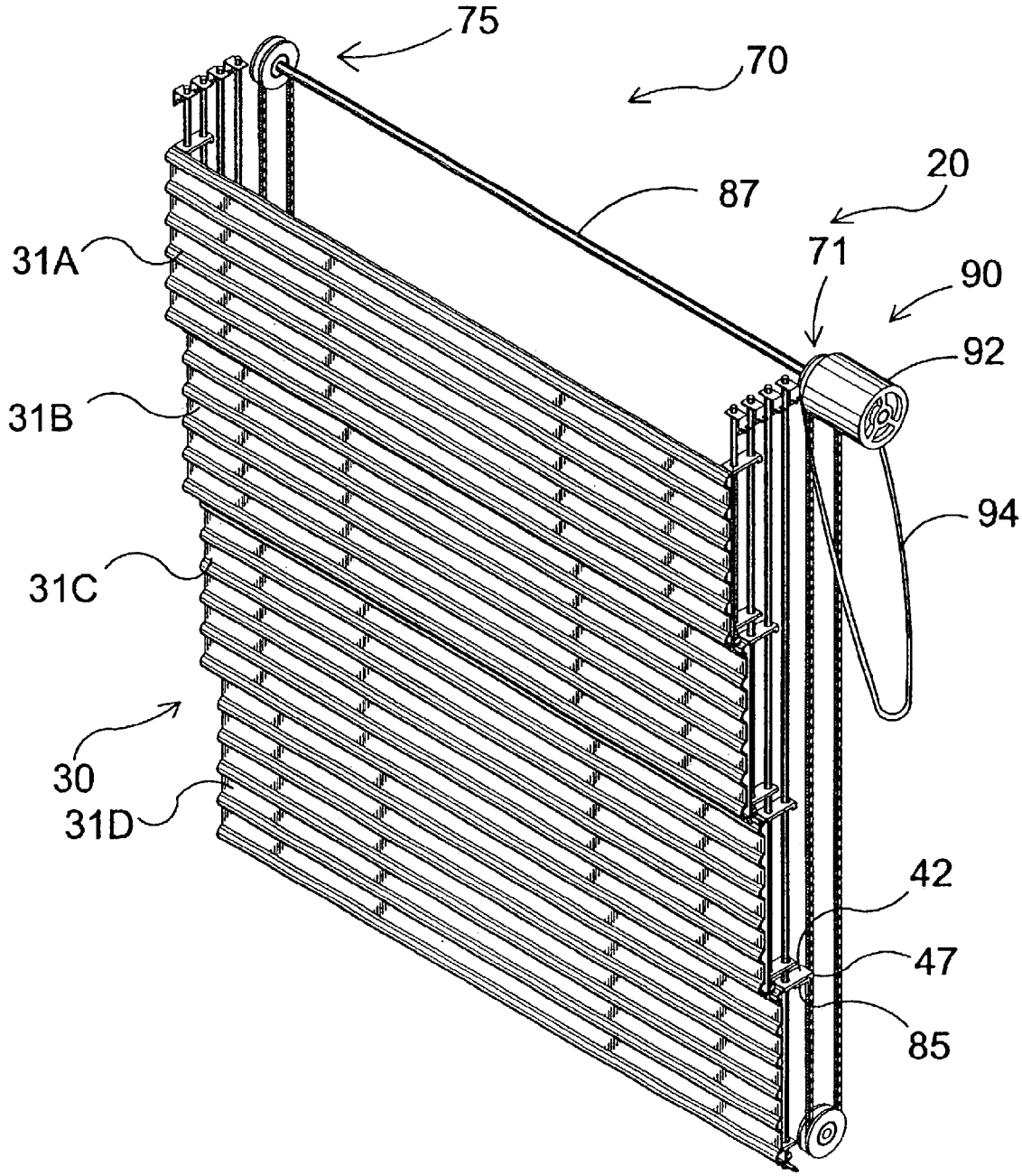
FIG. 6 is a frontal perspective view of a portion of the telescopic garage door assembly of FIG. 1.
Figure 7:
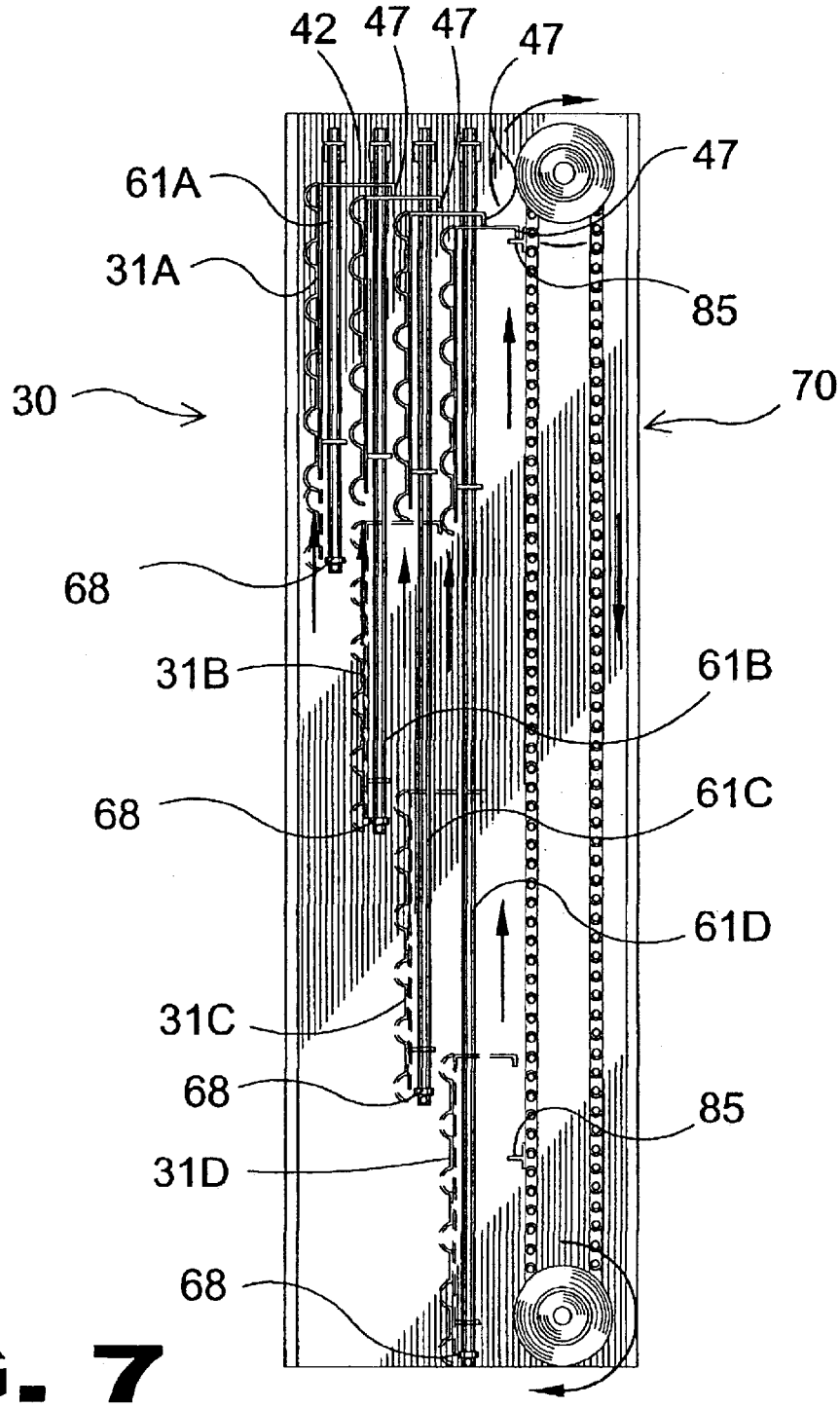
FIG. 7 is a cross-sectional side view of FIG. 5 showing the directional movement of the door assembly from the closed position to the open postion.
Figure 8:
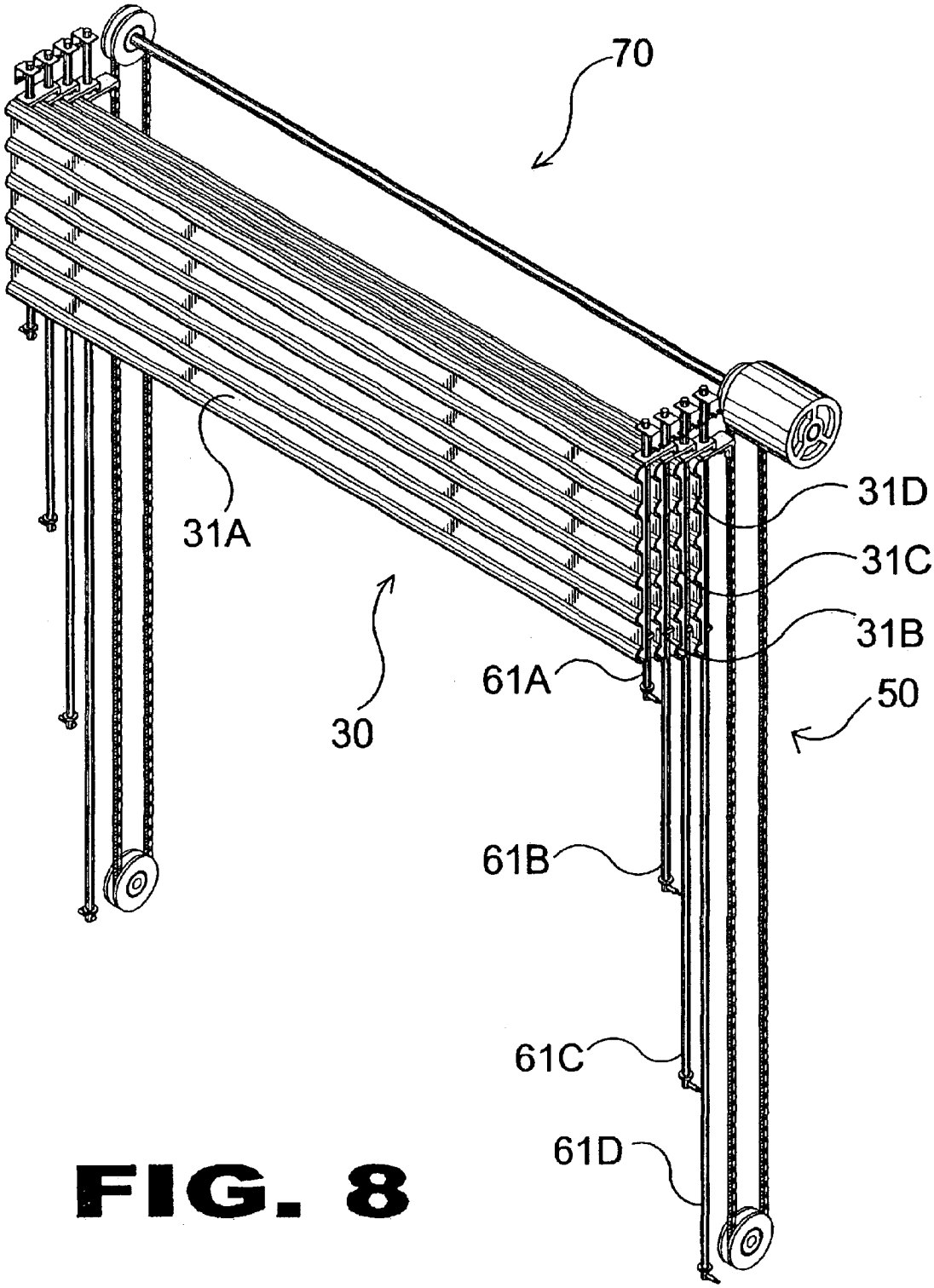
FIG. 8 is a perspective frontal view of the telescopic garage door assembly of FIG. 6 in an open position.
Figure 9:
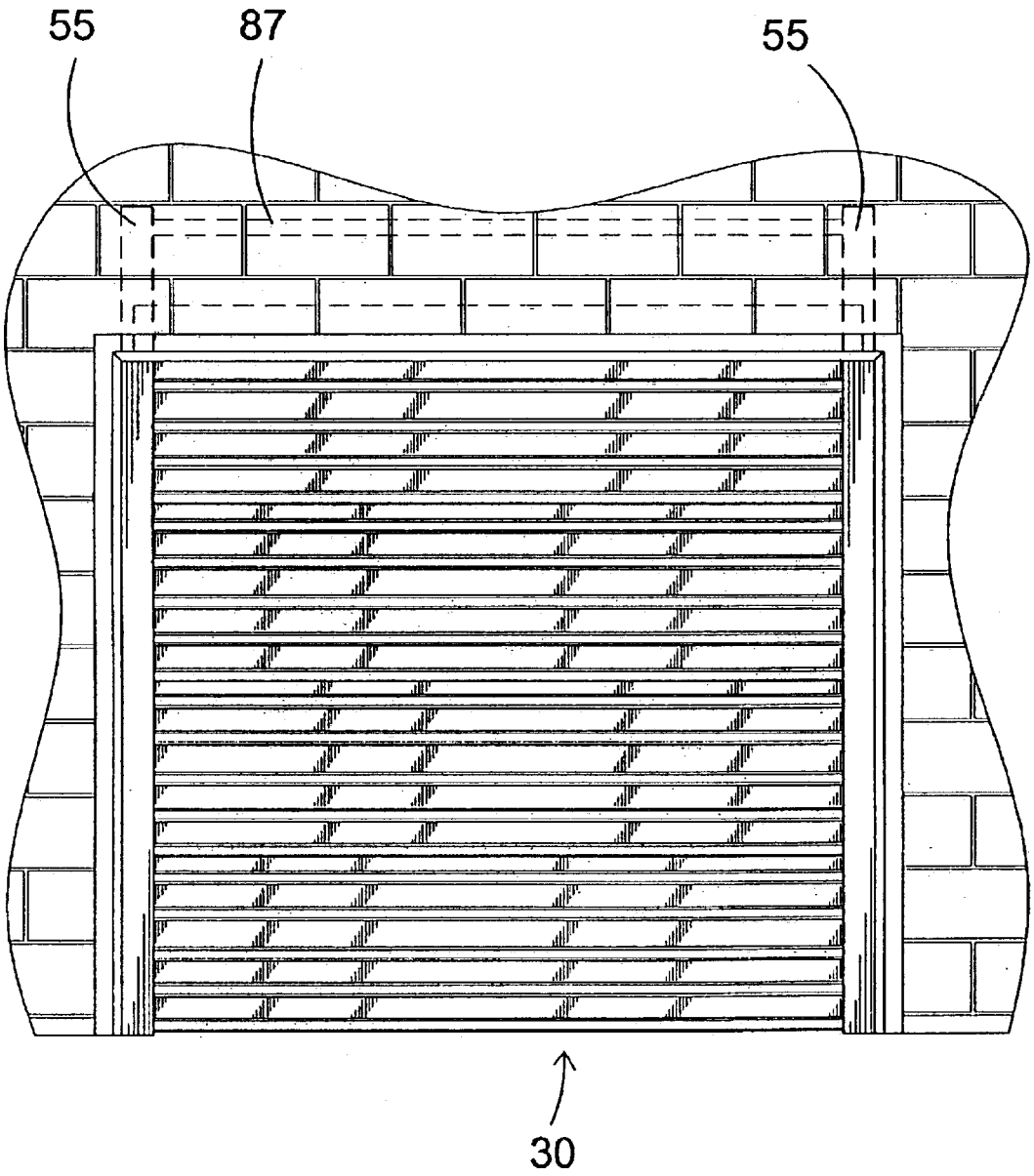
FIG. 9 is a frontal view of the telescopic garage door assembly of FIG. 1 positioned in a garage.
Figure 10:
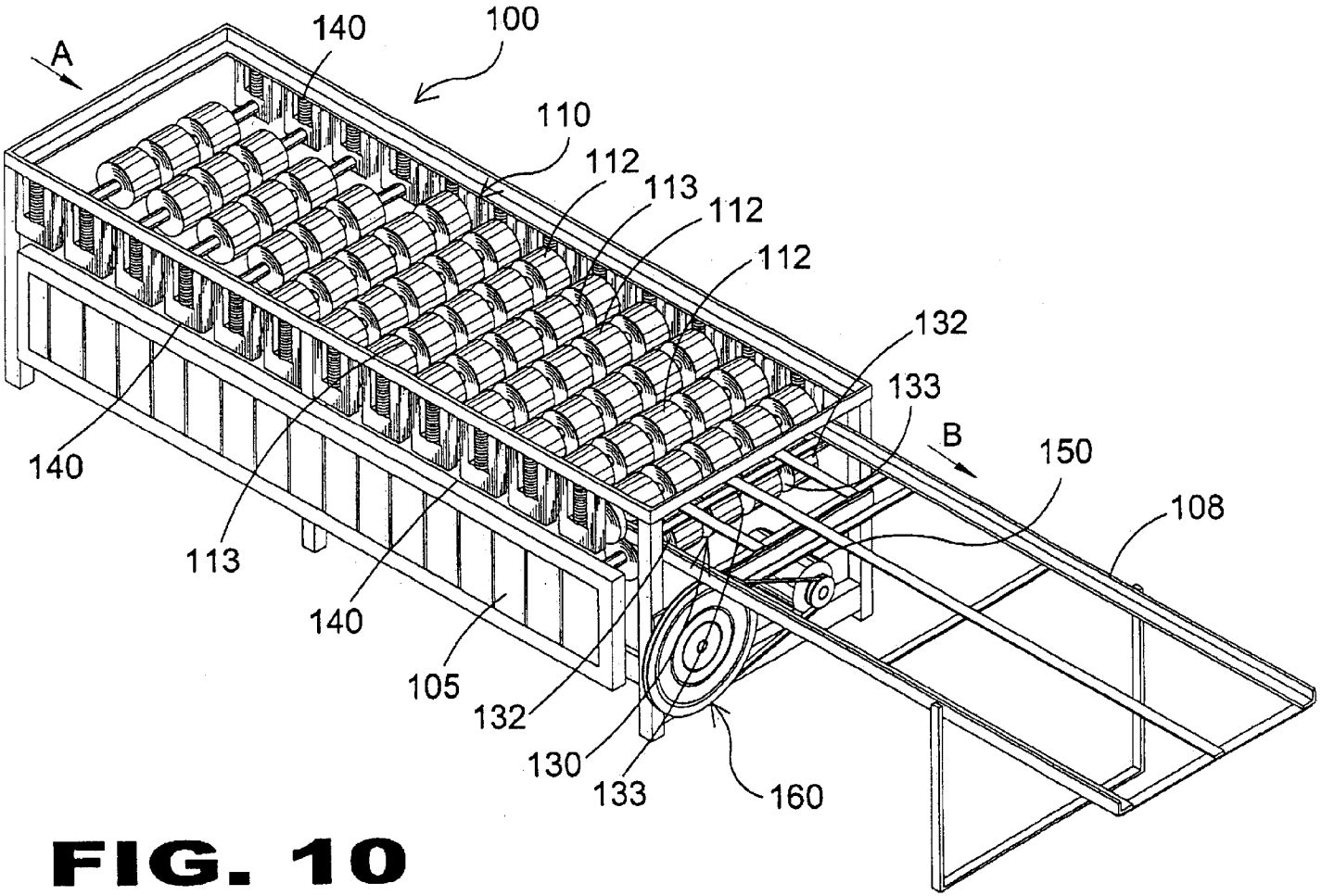
FIG. 10 is a perspective view of a door panel forming machine for the telescopic garage door of FIG. 1 constructed in accordance with the present disclosure.

Referring now in specific detail to the drawings in which like referenced numerals identify similar or identical elements throughout the several views, and initially to FIGS. 1 and 10, a novel telescopic garage door and panel forming apparatus 10 is shown with garage door assembly 20 installed in a garage. Garage door assembly 20 includes a plurality of panels 30 defining a garage door and means for movement 50 of the plurality of panels 30.

Garage door assembly 20 provides for the opening and closing of plurality of panels 30 by moving a plurality of interacting door panels between an open and a closed position. The present disclosure positions the plurality of panels generally vertical and adjacent the header of the garage door. This configuration obviates the need for horizontal track members fastened to the ceiling of the garage providing additional space within the garage thereby for storage of items.

Referring now to FIGS. 2–5, each panel 31 of plurality of panels 30 has a face 32, a back 33, a top 34, a bottom 35, a first side 36, and a second side 37. Panel face 32, in conjunction with opposing sides 36 and 37, defines an axis-X. Panel face 32, in conjunction with top 34 and bottom 35, defines an axis-Y perpendicular to axis-X. An axis-Z is defined between face 32 and back 33 of panels 30 that intersects and is perpendicular to axes X and Y.

Plurality of panels 30 are arranged in series in the direction of arrow-A with faces 32 in parallel. A first panel 31A at least partially defines atop of garage door assembly 20 and is followed by a number of panels 31. The number of panels employed in the plurality of panels is dependent on the height and width of the door. In this one preferred embodiment first panel 31A is followed by panels 31B, 31C, and 31D. Panel 31D defines at least a portion of the bottom of garage door assembly 20.

Plurality of panels 30 are preferably made of a sheet metal or metal alloy material, but can also be fabricated of one or more suitable wood, plastic, or composite materials. In the preferred sheet metal configuration, each panel 31 includes a plurality of semi-circular corrugations 38 parallel with axis-X configured for adding structural strength to panel 31.

Each panel 31 includes a pair of generally U-shaped brackets 40 with each bracket 41 having an upper flange 42 and a lower flange 48. Brackets 41 are positioned on back 33 in apposition with sides 36 and side 37. Flanges 42 and 48 extend generally parallel with axis-Z.

Upper flange 42 is an elongate flat member having a first length and is in apposition with top 34. Upper flange 42 defines two holes including a first hole 44 and a second hole 45. First hole 44 is closer to bracket 41 than second hole 45. Upper flange 42 has an end 46 having a lip 47. Lip 47 extends in a downward direction from end 46.

Lower flange 48 is an elongate flat member positioned in the general vicinity of the lower end of bracket 41 such that at least a portion of bracket 41 extends below flange 48. Flange 48 has a second length less than the first length of upper flange 42. Lower flange 48 defines a hole 49. First hole 44 on upper flange is aligned with hole 49 on lower flange 48. Holes 44 and 49 define a line generally parallel with axis-Y.

Means for movement 50 includes a framework 55, a plurality of guide rods 60, and a drive mechanism 70. Means for movement 50 provides the apparatus for moving the plurality of panels 30 between the closed position and the open position.

Each guide rod 61 of the plurality of guide rods 60 is fixed in position generally parallel with axis-Y. Guide rods 61 have a top 62 and a bottom 64 and are connected to framework 55 by brackets 66 positioned in the vicinity of top 62. Guide rods 61 bottoms 64 are connected by fastening means 67, such as bolts and nuts or screws and anchors, which also secure stops 68. Brackets 66 and fastening means 67 also provide a stand-off by positioning the plurality of guide rods 60 in fixed spaced relation to framework 55.

The plurality of guide rods 60 extend in the direction of axis-Z and each guide rod 61 is positioned in spaced relation such that a first rod 61A is positioned through holes 44 and 49 of upper flange 42 and lower flange 48 of panel 31A, respectively. A guide rod 61B is positioned adjacent or next to guide rod 61A in the direction of arrow-A and is aligned with and positioned in hole 47 of upper flange 42. Thus, upper flange 42 extends across two guide rods 61A and 61B. This arrangement continues through panels 31B–31C such that panel 31B has corresponding guide rods 61B and 61C and panel 31C has corresponding guide rods 61C and 61D. The bottom or last panel 31D has only one guide rod 61D.

In this one preferred application the first guide rod 61A define the shortest length from top 62A to bottom 64A with guide rods 61B and 61C having gradually increasingly lengths to bottoms 64B and 64C until fourth guide rod 61D with the longest length of distance from top 62D to bottom 64D.

Plurality of guide rods 60 are fixed in position such that tops 62 define a line parallel with axis-Z in this one preferred embodiment. The sequentially increasing lengths of plurality of guide rods 60 includes stops 68 configured to terminate the downward travel of panels 31. It is also envisioned, for example, that plurality of guide rods 60 can have a uniform length and adjustably positionable stops 68 along the length of guide rods 61.

The plurality of guide rods 60 in combination with first flanges 42 can include a locking mechanism associated with second hole 45 of flanges 42A, 42B, and 42C, wherein when flanges 42A, 42B, and 42C are uplifted a fixed increment, as for example, when being raised or lowered by another flange 42, flange 42 disengages from teeth positioned in the plurality of guide rods 60. Last flange 42D is locked in position by being connected with lifting means 85.

Framework 55 is preferably a pair of flat structural members positioned perpendicular to axes X and Y and in the vicinity of the plurality of panels 30 sides 36 and 37 for the structural support of the plurality of guide rods 60. Framework 55 can be a housing including suitably supported wood, plastic, metal, or composite panels suitable for connecting with brackets 66 and fastening means 67. Alternately, framework 55 can be a metal framework configured for structurally supporting tops 62 of the plurality of guide rods 60.

Drive mechanism 70 includes a first pair of pulleys 71 connected by a first flexible member 81, a second pair of pulleys 75 connected by a second flexible member 83, a synchronizing rod 85, and motive force means 90.

First pair of pulleys 71 includes an upper pulley 72 connected with a lower pulley 73 by a first flexible member 81. First flexible member 81 is preferably a chain, but can be configured as a toothed belt, for example. Second pair of pulleys 75 includes an upper pulley 76 connected with a lower pulley 77 by a flexible member 83. A synchronizing rod 87 connects upper pulleys 72 and 76 and is configured to keep a uniform rate of turns and distance of displacement by both pairs of pulleys.

Flexible members 81 and 83 include a lifting bracket 85 configured for being received by lip 47 of upper flange 42 of the last panel. Lifting bracket 85 is an elongate flat flange extending approximately parallel with axis-Z. In a first preferred embodiment, lifting bracket 85 defines a hole, slot, or indentation configured for receiving lip 47. In a second preferred embodiment lifting bracket 85 and upper flange 42 are connected by a link or other fastening means such as a nut and bolt. Lifting brackets 85 are positioned to act simultaneously on lips 47 of brackets 40 of the lowermost panel to move the plurality of panels between the open and closed positions.

One of upper pulleys 72 or 76 is connected with a motive force means 90, such as an electric motor 92, for the powered raising and lowering of the plurality of panels 30 using a switch or remote control device. Alternately, the motive force means 90 can be provided by a cord 94 for the manual raising and lower of plurality of panels 30.

Referring now to FIGS. 6–9, in operation telescoping garage door assembly 20 is shown initially positioned in the first or closed position. Framework 55 is positioned to provide structural support for plurality of guide rods 60. Plurality of panels 30 are positioned in descending sequence and in the direction of arrow-A as panels 31A, 31B, 31C, and 31D. Lifting brackets 85 of flexible members 81 and 83 are aligned for direct contact with lips 47D of upper flanges 42D.

Upon the suitable use of motive force means 90 initiating the raising of lifting bracket 85 towards synchronizing rod 87, lifting bracket 85 is placed into direct contact with lips 47D of flanges 42D. Lifting bracket 85 is configured to lift and ascend panel 31D by flange 42D along guide rod 61D. As panel 31D ascends, flange 42D comes into direct contact with lip 47C of flange 42C. Lifting bracket 85 then becomes the lifting force for panels 31D and 31C.

In a similar manner, panels 31B and 31A are added to load being elevated by lifting bracket 85 until flange 42A hits bracket 66A to stop its upward travel or a suitable opening is defined by the elevated plurality of panels 30. The open position is thus defined by lifting bracket 85 telescoping the plurality of panels 30 together with faces 32A–B parallel, flanges 42A–D in direct contact, and defining an opening suitable for the positioning of a vehicle within the garage. Each panel 31 is translated between the open and closed positions. In the open position the plurality of panels are stored adjoining the garage door frame header with panels 31A, 31B, 31C, and 31D being positioned in series.

Plurality of panels 30 are lowered to the closed position by the movement of lifting bracket 85 from the open position downward. Plurality of panels 30 descend together until stop 68 is hit by flange 48A arresting the downward movement of panel 31A. Panels 31B, 31C, and 31D continue downward until panels 31B, 31C, and 31D come into contact with their respective stops 68B, 68C, and 68D.

Referring now to FIG. 10, door panel forming machine 100 includes a housing 105, upper roller system 110, lower roller system 130, a motor 150, and a power transfer means 160.

Housing 105 is configured to provide structural support roller systems 110 and 130, bias means 140, source of power 150, power transfer means 160, and rack 108. Sheet metal is fed in rolls or sheets into a first end in the direction of arrow-A between rollers 110 and 130 and exits in the direction of arrow-B of door panel forming machine 100. Bias means 140 is connected with roller systems 110 and 130. Rack 108 extends from the second end of door panel forming machine 100 and has suitable length for holding and at least temporarily storing up to a specified quantity of separated lengths of panels. Forming machine 100 can include a cutting device suitable for rapidly separating sheet metal portions.

Roller system 110 includes a plurality of rollers 112 and roller system 130 includes a plurality of rollers 132. Rollers 112 and 132 are positioned in rows on axels and separated by gaps 113 and 133, respectively. Bias means 140 biases roller systems 110 and 130 together. Rollers 112 and 132 are preferably positioned and configured in combination with gaps 113 and 133 for forming four semi-circular corrugations as the sheet metal is run through the door panel forming machine 100. Motor 150 is connected with an external source of power and drives power transfer means 160 which spins at least one of rollers 112 and 132 so as to draw the sheet metal into and through door panel forming machine 100.

Although the illustrative embodiments of the present disclosure have been described herein with reference to the accompanying drawings, it is to be understood that the disclosure is not limited to those precise embodiments, and that various other changes and modifications may be affected therein by one skilled in the art without departing from the scope or spirit of the disclosure. All such changes and modifications are intended to be included within the scope of the disclosure.

What is claimed is:

1. A telescoping garage door assembly comprising:

a plurality of interacting panels defining a garage door, each panel of the plurality of panels having a front, and a back, the front of each panel defining a first plane and the first planes of the plurality of panels being parallel and in series such that the a first panel defines a top of the garage door and a last panel defines a bottom of the garage door;

a pair of brackets connected to the back of each panel, each bracket having flanges, the plurality of panels being positioned in spaced relation such that the upper flange of each panel interacts with the upper flange of the adjacent panel; and means for moving the plurality of interacting panels including a framework supporting a plurality of guide rods and a drive mechanism, each panel of the plurality of panels being connected to at least two guide rods by the flanges, the drive mechanism including a pulley system configured for receiving the flanges of the last panel, the pulley system being configured for moving the plurality of interacting panels along the guide rods between an open position and a closed position.

2. The telescoping garage door assembly of claim 1, wherein the bracket includes an upper flange and a lower flange, the upper flange defining two holes and a lip, the lower flange defining one hole.

3. The telescoping garage door assembly of claim 1, wherein the plurality of guide rods include adjustable stops and guide rod brackets, the stops and guide rod brackets being configured to limit the movement of the plurality of panels.

4. The telescoping garage door assembly of claim 1, wherein the plurality of guide rods are positioned in two rows, each row being aligned with the brackets and perpendicular to the first planes of the panels.

5. The telescoping garage door assembly of claim 2, wherein the plurality of guide rods are positioned in spaced relation such that the holes of the flanges of the plurality of panels are aligned with the plurality of guide rods, the plurality of panels being slidably movable along the plurality of guide rods.

6. The telescoping garage door assembly of claim 1, wherein the plurality of panels includes four panels and the plurality of guide rods includes four pairs of guide rods.

7. The telescoping garage door assembly of claim 1, wherein each of the panels of the plurality of panels has corrugations formed in the panel by a door panel forming machine.

8. The telescoping garage door assembly of claim 1, wherein the drive mechanism includes a flexible member being positioned around each pulley system, the pulley systems being interconnected and driven by a motive force means, the flexible members including lifting brackets configured for interacting with the upper flanges of the last panel, the means for moving being configured for moving the plurality of panels in the first planes defined by each panel between an open and a closed position by direct contact with the last panel, the direct contact of the lifting bracket with the last panel being configured to sequentially add adjoining panels to the movement of the last panel such that the plurality of panels are moved between the open position and closed position.

9. A telescoping garage door assembly comprising:

a plurality of panels defining a garage door, each panel of the plurality of panels having a front, a back, a top, a bottom, a first side, and a second side, the front of each panel defining a first plane and the first planes of the plurality of panels being parallel, the plurality of panels being arranged in series such that the a first panel defines the top of the door and a last panel defines a bottom of the door;

a pair of brackets connected to the back of each panel, each bracket having flanges including an upper flange and a lower flange, the upper flange and the lower flange defining a plurality of holes, the plurality of panels being positioned in spaced relation such that the upper flange of each panel interacts with the upper flange of the adjacent panel;

means for moving the plurality of panels including a framework configured for supporting a plurality of guide rods and a drive mechanism, the guide rods being configured for positioning through the plurality of holes defined in the flanges, the means for moving including a pair of pulley systems configured for moving each panel of the plurality of panels along at least two guide rods in the first plane defined by each panel between an open position and a closed position.

10. The telescoping garage door assembly of claim 9, wherein the plurality of guide rods include adjustable stops and guide rod brackets, the stops and guide rod brackets being configured to limit the movement of the plurality of panels.

11. The telescoping garage door assembly of claim 9, wherein the upper flanges have lips.

12. The telescoping garage door assembly of claim 9, wherein the drive mechanism includes two pairs of interconnected pulley systems, each pulley system having a flexible member, each flexible member including a lifting bracket configured for interacting with one of the upper flanges of the last panel.

13. The telescoping garage door assembly of claim 9, wherein the means for moving is configured for moving the plurality of panels between an open and a closed position by direct contact with the last panel, the direct contact of a lifting bracket with the lowermost panel being configured to move the last panel and sequentially position the remaining panels between the open position and closed position.

14. The telescoping garage door assembly of claim 9, wherein the plurality of panels include four panels and the plurality of guide rods includes four pairs of guide rods.

15. A telescoping garage door assembly comprising:

a plurality of panels defining a garage door, each panel of the plurality of panels having a front, a back, a top, and a bottom, the front of each panel defining a first plane and the first planes of the plurality of panels being parallel, the plurality of panels being arranged in series such that the a first panel defines the top of the door and a last panel defines the bottom of the door;

a pair of brackets connected to the back of each panel, each bracket having flanges including an upper flange and a lower flange, the upper flange defining two holes and a lip, the lower flange defining one hole, the plurality of panels being positioned in spaced relation such that the upper flange of each panel interacts with the top of the adjacent panel;

means for moving the plurality of panels including a framework configured for supporting a plurality of guide rods and a drive mechanism, the framework being configured to support the positioning of the plurality of guide rods, the plurality of guide rods being positioned in rows perpendicular to the first planes of the panels and aligned with the brackets, the plurality of guide rods being positioned in spaced relation such that the guide rods are aligned with the holes defined in the flanges of the respective panels for the movement of the panels along the guide rods between an open and a closed position, and the drive mechanism including two interconnected pulley systems, each pulley system having a pair of flexible members, the flexible members including lifting brackets configured for interacting with the upper flanges of the lower most panel, the means for moving being configured for moving the plurality of panels between an open and a closed position by the direct contact of the lifting bracket with the last panel, the direct contact of the lifting bracket with the lip of the upper flange of the last panel being configured to move the last panel and sequentially add the moving of the adjoining panels between the open position and closed position.

16. The telescoping garage door assembly of claim 15, wherein the plurality of panels are moved in the first plane defined by each panel between the open position and closed position.

17. The telescoping garage door assembly of claim 15, wherein each of the panels of the plurality of panels is formed by a door panel forming machine, the panel forming machine defining corrugations in each panel.

18. The telescoping garage door assembly of claim 15, wherein the plurality of guide rods include adjustable stops and guide rod brackets, the stops and guide rod brackets being configured to limit the movement of the plurality of panels.

* * * * *